United States Patent [19]

Takeda et al.

[11] 4,367,466

[45] Jan. 4, 1983

[54] DISPLAY CONTROL APPARATUS OF SCANNING TYPE DISPLAY

[75] Inventors: Genyo Takeda, Nagaokakyo; Masato Hatakeyama, Uji, both of Japan

[73] Assignee: Nintendo Co., Ltd., Kyoto, Japan

[21] Appl. No.: 276,194

[22] Filed: Jun. 22, 1981

[30] Foreign Application Priority Data

Jun. 24, 1980 [JP] Japan ..... 55-86968

[51] Int. Cl.[3] ..... G09G 1/16

[52] U.S. Cl. ..... 340/725; 340/701; 340/724; 340/799

[58] Field of Search ..... 340/724, 725, 726, 728

[56] References Cited

U.S. PATENT DOCUMENTS 4,070,710 1/1978 Sukonick et al. ..... 340/724 X

*Primary Examiner*—David L. Trafton

*Attorney, Agent, or Firm*—W. G. Fasse; D. H. Kane, Jr.

[57] ABSTRACT

A screen of a scanning type display is divided both in the horizontal and vertical directions or abscissa and ordinate directions into a relatively large number of dots, so that the screen comprises an arrangement of dots (of the total number of the relatively large number by the relatively large number) arranged in the horizontal and vertical directions. The arrangement of dots of the screen is divided into columns each having a relatively small number of dots in the horizontal or abscissa direction. Each column is identified by a corresponding ordinal number so that the same may be the abscissa information. On the other hand, each row of each column is identified by a corresponding ordinal number so that the same may be the ordinate information. Two line buffer memories are provided for storing display control information of lines which are different by a predetermined number of lines in the vertical direction. These line buffer memories are alternately controlled such that while one is in a write mode the other is in a read mode, whereby the same are alternately changed to the write mode and the read mode for each line of the horizontal scanning lines. Character information is read from a character pattern storing memory responsive to the display control information read from the other line buffer memory. A display position of the character is freely changed in the vertical direction and/or the horizontal direction on a dot-by-dot basis by controlling the read timing of the character information. A deformed character can also be displayed from the same character information by changing for each line the reading of the character information.

9 Claims, 9 Drawing Figures

DISPLAY CONTROL APPARATUS OF SCANNING TYPE DISPLAY

BACKGROUND OF THE INVENTION

1. Field of the Invention

The present invention relates to a display control apparatus of a scanning type display. More specifically, the present invention relates to an improvement in a display control for displaying an image symbol on a scanning type display using a character pattern storing memory.

2. Description of the Prior Art

Of late, a so-called video game apparatus for displaying images of a variety of configurations using a scanning type display of such as a cathode-ray tube has been put into practical use. A graphic system and a character system have been well-known as a system for controlling display of images on a cathode-ray display, for example, in a conventional video game apparatus. A typical graphic system is disclosed in U.S. Pat. No. 4,016,362 issued Apr. 5, 1977 to Stephen D. Bristow and Steven T. Mayer. The principle of such graphic system will be briefly described subsequently with reference to FIG. 1. On the other hand, a typical character system is disclosed in U.S. patent application Ser. No. 706,121 now U.S. Pat. No. 4,116,444 filed by July 16, 1976 by Steven T. Mayer. The principle of such character system is also briefly described subsequently with reference to FIG. 2.

FIG. 1 is a block diagram showing one example of a conventional apparatus for controlling display of images on a cathode-ray tube display in accordance with a graphic system. The graphic system display shown is adapted such that a desired character is displayed by a television receiver which is an example of a cathode-ray tube display directly storing information of a variety of characters being displayed on a screen of the television receiver 1 in a random access memory 14 and is referred to as a direct random access memory system.

Now referring to FIG. 1, a structure of a graphic system display shown will be described. Assuming that the screen of the display of the television receiver 1 is constituted by an arrangement of dots, with 256 dots both in the horizontal and vertical directions, the random access memory 14 is adapted to store information of each bit of the screen of the display of the television receiver 1 in one bit position of the memory and to that end the random access memory 14 has a storage capacity of 256×256 bits positions. Taking into consideration the fact that a computer or a microcomputer usually used in such video game apparatus comprises a data structure of eight bits, preferably the random access memory 14 is structured to have a capacity of 8129 words, each word being eight bits, i.e. eight kilobytes in total. However, the foregoing discussion is based on the fact that display is made in terms of two values of black and white. As to be described subsequently, the random access memory 14 is controlled to store image data being displayed on the screen of the display of the television receiver 1 and the random access memory 14 is then controlled to provide the stored image data through a read operation.

The central processing unit 11 is responsive to a program stored in advance to generate data being written in the random access memory and address data for specifying the addresses where the data being written is to be written, thereby to perform a write control and also to perform an arithmetic operation in the case where a game is to be played using images being displayed on the screen on the display of the television receiver 1. The write address data being obtained from the central processing unit 11 is applied to an address data switch circuit 12. The data being written or simply write data obtained from the central processing unit 11 is applied to a write/read data switch circuit 15. The switch circuit 12 is connected to receive a synchronizing signal from a synchronizing counter 13 as read address data. The synchronizing signal generated by the synchronizing counter 13 is a signal in synchronism with horizontal scanning and vertical scanning of the television receiver 1. The switch circuits 12 and 15 are also supplied with a switch signal. The switch signal is a write signal of the high level during the vertical blanking period, thereby to select a write mode by switching the switch circuits 12 and 15 to the central processing unit 11. The switch signal also becomes a read enable signal of the low level during the period other than the vertical blanking period, thereby to select a read mode by switching the switch circuit 12 to the synchronizing counter 13 and by switching the switch circuit 15 to a parallel/serial converter 16.

In operation, during the vertical blanking period the switch circuits 12 and 15 are switched to the central processing unit 11, whereby the write mode is established. In the write mode the write address data obtained from the central processing unit 11 is applied through the switch circuit 12 to the random access memory 14. At the same time the write data obtained from the central processing unit 11 is applied through the switch circuit 15 to the random access memory 14. Therefore, the random access memory 14 is loaded with the write data in the addresses designated in high speed.

On the other hand, during a period other than the vertical blanking period the switch circuits 12 and 15 are turned to the read mode. Therefore, the synchronizing signal of the output from the synchronizing counter 13 is applied through the switch circuit 12 to the random access memory 14 as the read address data. As a result, the random access memory 14 is controlled so that the write data is read out. The data as read out from the random access memory 14 is applied through the switch circuit 15 to a parallel/serial converter 16. The parallel/serial converter 16 serves to convert the parallel data of eight bits read out from the random access memory 14 into a serial data format and the converted output is applied through an OR gate 17 to the television receiver 1. At the same time a composite synchronizing signal including a horizontal synchronizing signal and a vertical synchronizing signal is applied through the OR gate 17 to the television receiver 1. As a result, an image symbol or image symbols are displayed on the screen of the display of the television receiver 1 based on the data stored in the random access memory 14. Thereafter the above described operation is repeated per each cycle of the vertical blanking signal.

However, since the graphic system display requires that the random access memory 14 has a capacity of the number of bits corresponding to the number of dots of one screen, the same involves a disadvantage that an increased capacity of high expense is required in performing a colored display and a brightness controlled display. In addition, the central processing unit 11 needs to control a write operation of the data into all the addresses of the random access memory 14 by using a major portion of the processing capability of the central processing unit 11 and therefore the central processing unit 11 cannot be used in brain-like processing such as strategy inherently required in a game by such video game apparatus, which imposed a major restriction in a game. In order to eliminate such restriction in a game, the central processing unit need be of a high speed processing or need be of one which has been specially designed for such brain-like processing such as a strategy in a game. Nevertheless, another disadvantage is involved that such approach makes the cost very expensive.

Accordingly, in order to reduce a storage capacity of a random access memory and to mitigate a burden of a processing capability of a central processing unit, a display of a character system has also been proposed.

FIG. 2 is a block diagram of an example of an apparatus for controlling display of images on a conventional cathode-ray tube display in accordance with a character system. In a character system display shown, the screen of the television receiver 1 comprises an arrangement of a plurality of blocks arranged in 32 rows and 32 columns. Each of the columns is identified by a corresponding ordinal column number being allotted starting from the left end of the screen. On the other hand, each of the rows is identified by a corresponding ordinal row number starting from the top end of the screen. In other words, each of the blocks is allotted the corresponding ordinal column number and the corresponding ordinal row number to indicate the location thereof with the left upper corner of the screen as the origin. Each of the blocks comprises an arrangement of dots arranged in rows and columns, say $8\times8$ dots. In displaying a character at a desired position on the screen, the position is determined by address information representing the column number and the address information representing the row number.

In order to store in advance a plurality of kinds of characters each being displayed as a moving image symbol or object by means of a given block of the lattice, a character storing memory 28 is provided. The random access memory 24 comprises addresses of the number, say $32\times32=1024$ addresses, corresponding to the number of blocks in the lattice on the screen of the television receiver 1. The respective addresses of the random access memory 24 are determined to store information for identifying characters each being displayed as a moving image symbol by a corresponding block. Meanwhile, referring to FIG. 2, the same portions as those in FIG. 1 have been denoted by the same reference characters and a detailed description thereof will be omitted.

In operation, during the vertical blanking period the switch circuits 12 and 15 are switched to the central processing unit 11, whereby the write mode is established. At that time the central processing unit 11 provides through the switch circuit 12 to the random access memory the write address data for designating the respective blocks out of a plurality of blocks being displayed on one screen and also provides through the switch circuit 15 to the random access memory 24 the character identifying information representing the kind of the characters being displayed by the respective blocks. To that end, the random access memory 24 is in succession loaded with the character identifying information at the addresses corresponding to the respective blocks.

On the other hand, during the period other than the vertical blanking period the switch circuits 12 and 15 are switched to the read mode. At that time the synchronizing counter 23 provides the read address data for designating the position in the column number and row number responsive to the horizontal synchronizing signal and the vertical synchronizing signal for controlling the display of the television receiver 1. The read address data is applied through the switch circuit 12 to the random access memory 24. Accordingly, the character identifying information being displayed is read out from the random access memory 24 and is applied through the switch circuit 15 to the character storing memory 28. On the other hand, the synchronizing counter 23 provides to the character storing memory 28 the information designating the row number of the characters being designated by the character identifying information based on the vertical synchronizing signal. Accordingly the character information being displayed on the position of the block in synchronism with the horizontal synchronizing signal and the vertical synchronizing signal is read out in a bit parallel fashion from the character storing memory 28. The character identifying information is converted by the parallel/-serial converter 16 into a serial data format and the same is applied through the OR gate 17 to the television receiver 1.

Thus, according to the character system display, the central processing unit merely controls a write operation of the character identifying information into 1024 addresses at the maximum of the random access memory 24 and as a result a processing time period required for controlling image display is drastically shortened. In addition, the character system display can mitigate the burden of the central processing unit 11 and also can decrease a storage capacity of the random access memory 24.

However, while the character system display can be advantageously utilized in a case where still images such as letters, numerals and the like are displayed, the same is not suited for display of a movable image symbol such as displayed in a video game apparatus. The reason will be described in detail with reference to FIG. 3. The character system display can display a desired moving image symbol only at a predetermined position of the coordinates of the blocks of the divided rows and the columns on the screen of the television receiver 1. For example, as shown in FIG. 3, in the case where a given moving image symbol is to be displayed by designating the forth columns ($H=4$) and the third row ($V=3$), the designated address of the display position of the moving image symbol is $H=4$, $V=3$. In the case where the symbol is to be moved in the rightward direction, assuming that the target address is $H=5$ and $V=3$, the symbol is displayed at the position spaced apart in the rightward direction by one column. Similarly, in the case where the symbol is to be moved in the rightward and downward inclined direction, assuming that the target address is $H=5$ and $V=4$, the symbol is displayed to be spaced apart in the rightward and downward oblique direction by one block. Therefore, the moving image symbol looks as rapidly flying or moving one block by one block and such movement is observed as unnatural movement.

Meanwhile, in such video game apparatus, it is necessary that character symbols be moved. However, a character system display for moving a symbol on a block by block basis causes an impression that the movement of a moving image symbol is extremely unnatural. Nevertheless, it was hardly possible to show smooth movement of an image symbol. In addition, a character system display involves a limitation to display positions where images can be displayed on the screen of the television receiver 1, i.e. involves a disadvantage that moving symbol images cannot be displayed at any desired number of display positions.

SUMMARY OF THE INVENTION

In summary, the present invention comprises two indirect line buffer memories having storing regions corresponding to the number of columns at every predetermined number of lines of the horizontal scanning lines of a scanning type display. Data is written in one line buffer memory while the data loaded in the other line buffer memory is read out, alternately at every predetermined number of lines of the horizontal scanning lines. The data written in the line buffer memory or read from the line buffer memory comprises abscissa information and ordinate information and character identifying information for designating the column of an image symbol being displayed on the screen. The memory storing the character pattern is controlled to read the character pattern responsive to such data, thereby to make variable the display position of the character at least in the vertical direction as compared with a conventional character system display.

According to the present invention, a display control apparatus of a scanning type display is provided which is adapted for changing as desired a display position of a desired character at least in a vertical direction, wherein the burden of a central processing unit is mitigated and the storage capacity is decreased.

In a preferred embodiment of the present invention, a desired character is displayed at a display position so that the same may be shifted in the horizontal direction by a given number of dots with respect to the column number responsive to the abscissa information. As a result, the display position of the desired character can be changed to any position in the horizontal and vertical direction on the screen of the scanning display.

In a preferred embodiment of the present invention, the number of dots for shifting per each line of the character pattern information is selected to be different based on modified command information, whereby a plurality of kinds of characters is displayed from the same character pattern information. As a result, the storage capacity of the character pattern storing memory can be decreased.

Accordingly, a principal object of the present invention is to provide a display control apparatus of a scanning type display which is capable of changing as desired a display position of a desired character in at least the vertical direction, wherein the burden of a central processing unit is mitigated and the storage capacity is decreased.

Another object of the present invention is to provide a display control apparatus of a scanning type display which is capable of changing the display position of a desired character to any position in the horizontal and vertical direction on the screen.

A further object of the present invention is to provide a display control apparatus of a scanning type display which is capable of displaying a character in a different kind or shape based on the same character pattern information.

A still further object of the present invention is to provide a display control apparatus of a scanning type display advantageously applicable as a video game apparatus, wherein a moving image symbol for a video game can be displayed as smoothly moving using a simple structure.

It is another object of the present invention to provide a display control apparatus of a scanning type display, wherein the color and the brightness of a moving image symbol can be controllably displayed with a simple structure.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
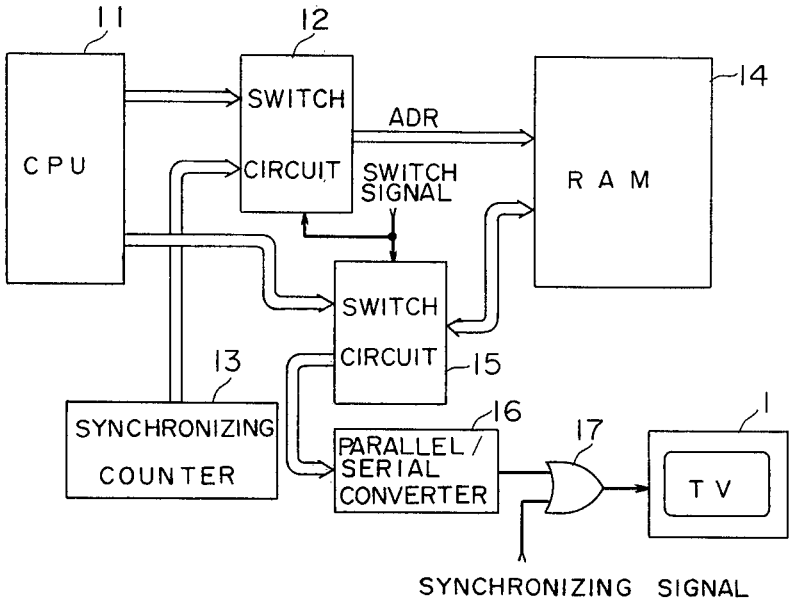
FIG. 1 is a block diagram showing one example of an apparatus for controlling display of images on a conventional cathode-ray tube display in accordance with the graphic system.
Figure 2:
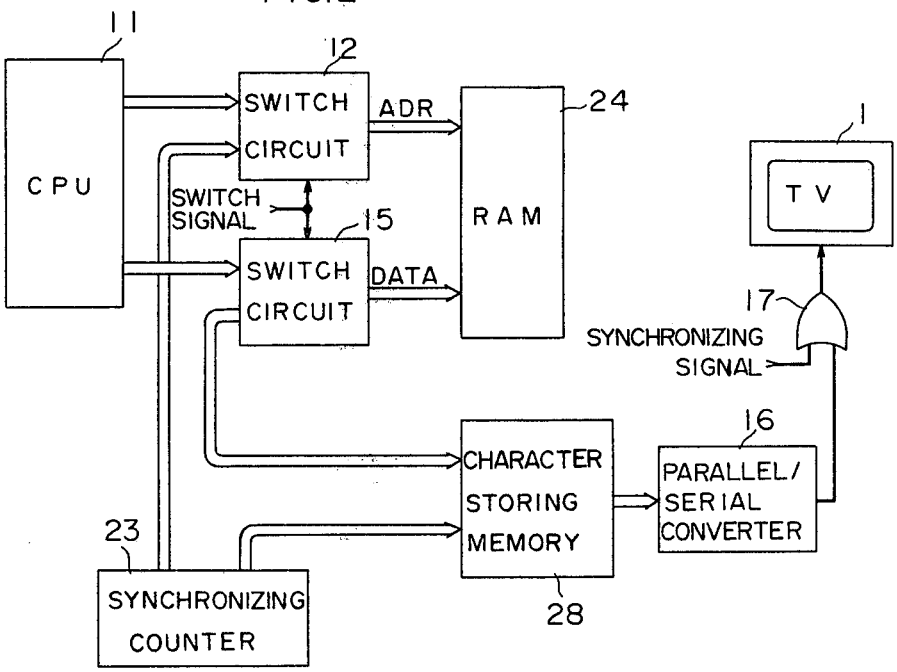
FIG. 2 is a block diagram showing an example of an apparatus for controlling display of images on a conventional cathode-ray tube display in accordance with the character system.
Figure 3:
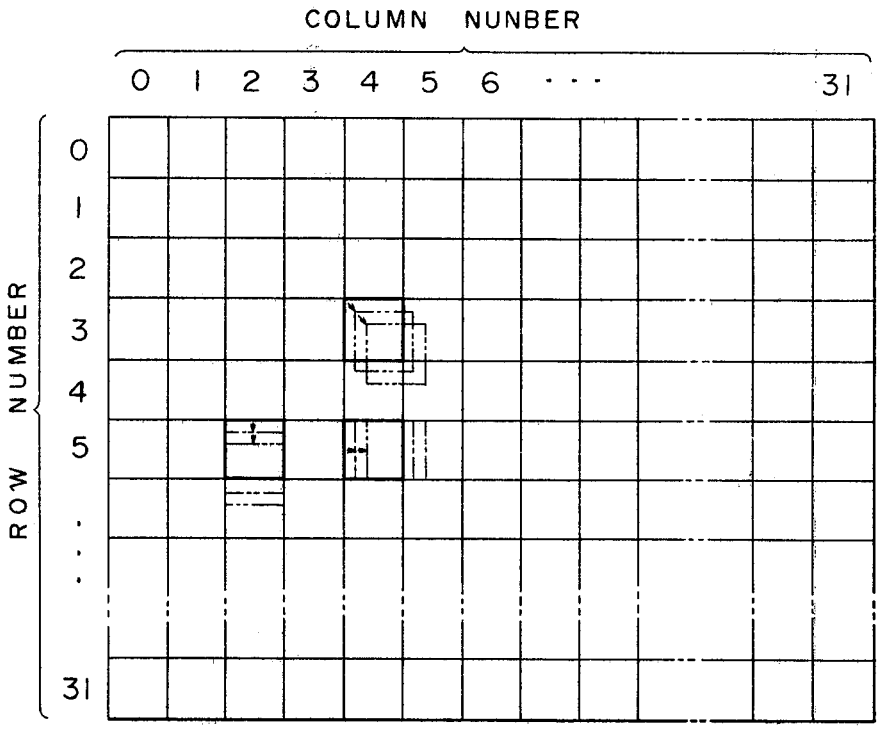
FIG. 3 is a view diagrammatically showing a screen of a scanning type display for explaining the conventional character system.
Figure 4:
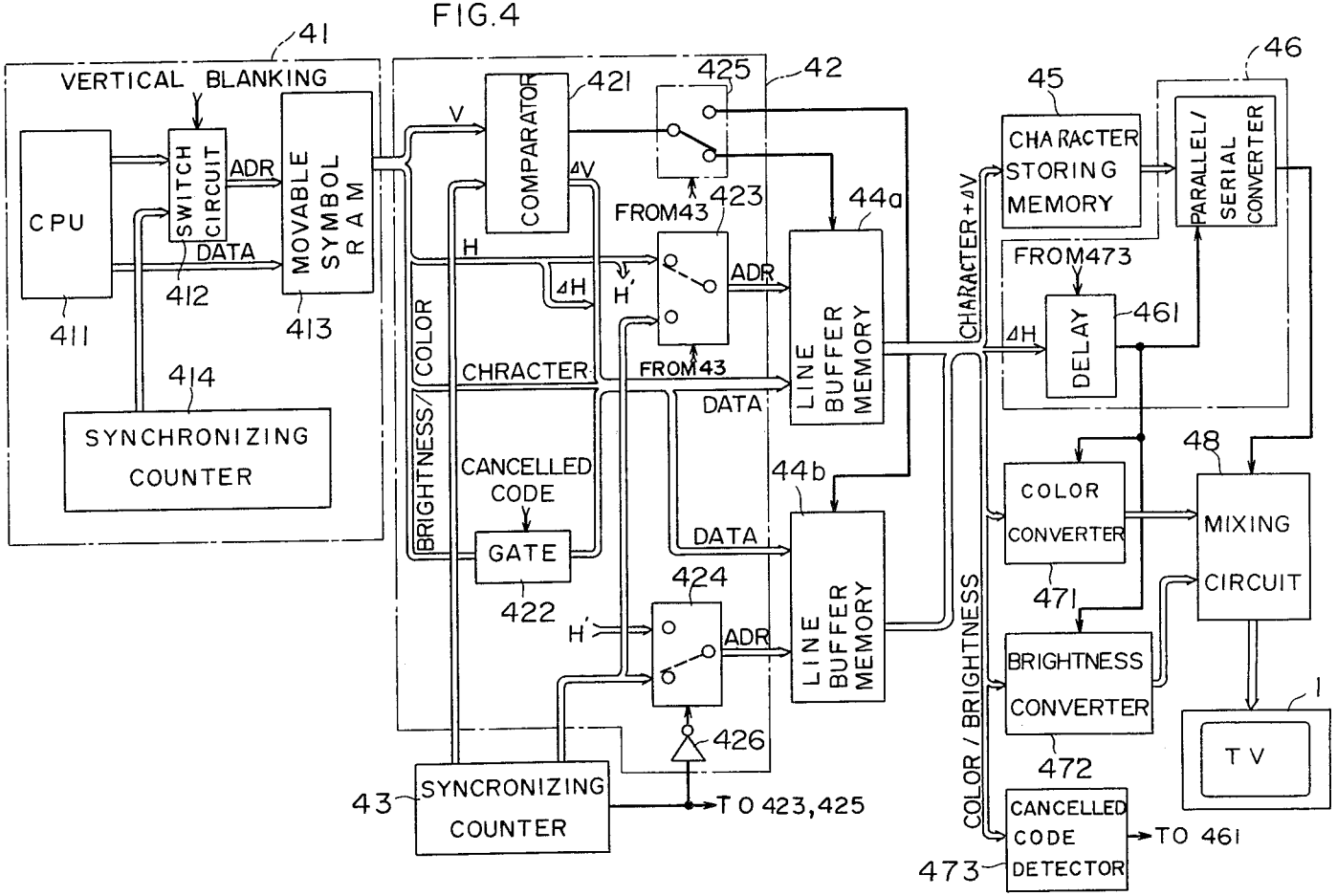
FIG. 4 is a block diagram of one embodiment of the present invention.

FIG. 4 is a block diagram of a display control apparatus of a scanning type display in accordance with one embodiment of the present invention.

Now before entering into a detailed description of the embodiment of the present invention, description will be made of a convention for indicating the location or position on the screen employed in describing the present invention. In the present invention, the screen of the display of the television receiver 1 is selected to comprise 256 horizontal lines and the screen is then divided into 32 columns. Each of the columns is further divided into 8 dot columns, so that each of the columns comprises an arrangement of dots arranged in 256 rows and 8 dot columns. Each of the columns is identified by a corresponding ordinal column number allotted starting from the left end of the screen. The ordinal column numbers are used as abscissa information. On the other hand, each of the 256 lines is identified by corresponding ordinal numbers allotted starting from the top end of the screen. The ordinal numbers are used as ordinate information.

The display control apparatus of the embodiment shown comprises display control information generating means 41, write/read control means 42, a random access memory reading synchronizing counter 43 as one example of read control signal generating means, line buffer memories 44*a* and 44*b*, a character pattern storing memory 45 and pattern information withdrawal control means 46. The display control apparatus may further comprise a color converter 471, a brightness converter 472, a cancellation code detector 473 and a mixing circuit 48, as necessary.

More specifically, the display control information generating means 41 comprises a central processing unit 411. The central processing unit 411 may be a microprocessor, for example, which has a function for performing an arithmetic operation based on a prestored program. The central processing unit 411 is responsive to the program to provide write data being displayed on the screen to a moving symbol random access memory 413 and also provides write address data designating write addresses to a write/read address switch circuit 412. The switch circuit 412 is responsive to a switch signal to switch the kinds of the address data. More specifically, the switch circuit 412 selects a write mode in the vertical blanking period, thereby to provide the write address data obtained from the central processing unit 411 to the random access memory 413, while its selects a read mode during a period other than the vertical blanking period to provide a synchronizing signal obtained from a random access memory reading synchronizing counter 414 to the random access memory 413 as read address data. The random access memory 413 has a storage capacity capable of storing at one time all the image symbol units on the screen. The random access memory 413 stores, per each image symbol, abscissa information, reference ordinate information, character identifying information or a character code, and a color/brightness code. For example, the abscissa information is selected to be a data length of eight bits. The more significant five bits of the abscissa information represent the column number. The less significant three bits of the abscissa information represent additional abscissa information ΔH for designating the display position where the symbol is to be displayed at how many dots shifted in the rightward direction from the left end dot of each column. The reference ordinate information is also selected to be of a data length of eight bits. The reference ordinate information represents a reference of the dot position in the ordinate or vertical direction in terms of the image symbol, i.e. the origin point in the ordinate. The character code is determined by the character kind stored in the character storing memory 45 to be described subsequently and, assuming that there are 256 kinds of characters, the same is selected to be a data length of eight bits. The color/brightness code is selected to be eight bits. Accordingly, the data length per each image symbol is 32 bits and, assuming that the random access memory 413 is a memory of a 8-bit structure, the data of the image symbol units can be stored by four bytes. The synchronizing counter 414 controls a reading operation of the information stored in the random access memory 413 in succession of columns for each horizontal scanning line during the period other than the vertical blanking period.

The above described write/read control means 42 comprises a read mode, and a switch circuit 425 for alternately switching a write enable signal to a line buffer memory 44*a* or 44*b*. The reference ordinate information V read from the above described random access memory 413 is applied to the comparator 421. The comparator 421 is supplied with information representing an ordinate position preceding, by a predetermined number of lines, the ordinate position of the actual horizontal scanning line of the television receiver 1 from a television synchronizing counter 43 to be described subsequently. By the above described predetermined number of lines, one line is meant in the case where the cathode-ray tube display is of a sequential scanning type and the number of lines corresponding to one cycle is meant in the case of sequential scanning in the case where the cathode-ray tube display is of an interlaced scanning type. The comparator 421 is responsive to the reference ordinate information V of a character being written and the output of the synchronizing counter 43 to serve as additional ordinate information generating means for providing additional ordinate information ΔV and to generate a write enable signal in the case where the difference of both inputs is 0 to 7. The more significant five bits (i.e. the information representing the coordinate position of the column number) out of the eight bits of the abscissa information are applied to the switch circuits 423 and 424, while the less significant three bits (i.e. the additional abscissa information ΔH) out of the eight bits of the abscissa information are used as write data. The information ΔH, the information ΔV, the character code and the color/brightness code obtained from the OR gate 422 or the cancellation code representing absence of write data are applied to the line buffer memories 44*a* and 44*b* as write data.

The above described line buffer memories 44*a* and 44*b* comprise a plurality of bits (32×8 bits) for storing write data of the color/brightness code (8 bits), the character code (8 bits), the information ΔH (3 bits) and the information ΔV (3 bits) per each column in the case where one line of the horizontal scanning line is divided into a plurality (32) of columns. The line buffer memories 44*a* and 44*b* are alternately and repetitively controlled for a write and read operation such that data is written into one of them while data is read from the other of them per each column with respect to the information of one line of the horizontal scanning line.

The synchronizing counter 43 generates a horizontal synchronizing signal in synchronism with the horizontal scanning line of the television receiver 1 and the same is applied to the switch circuits 423 and 424 as read address data. The synchronizing counter 43 provides a switch signal at every odd number (or even number) scanning lines of the horizontal scanning lines, which are applied to the switch circuits 423 and 424.

The above described character storing memory 45 is selected to store characters being displayed on an image symbol-by-image symbol basis in terms of the bit numbers (say 8×8 bits) corresponding to the dot number of the image symbol unit. The character storing memory 45 stores pattern information of a desired character depending on whether the logic zero or one is stored at which bit among 8×8 bits, thereby to store a plurality of kinds of characters (say 256). The above described character storing memory 45 is supplied with the character code read from any one of the line buffer memories 44*a* and 44*b* and the information αV.

The above described pattern information withdrawal control means 46 comprises a delay 461 and a parallel/serial converter 462. The delay 461 is aimed to delay an operation start timing of the parallel/serial converter 462 based on the additional abscissa information ΔH, thereby to start the reading operation of the character information at the position dislocated from the left-most dot position of the columns by the a desired dot number.

To that end, the delay 461 is adapted to generate a delay signal associated with the additional abscissa information ΔH as a conversion start command signal. Another example of the delay 461 may be a counter adapted such that a numerical value associated with the value ΔH is set and the set value is subtracted for each dot period one by one, so that a conversion start command signal may be obtained when the set value becomes zero.

Figure 5:
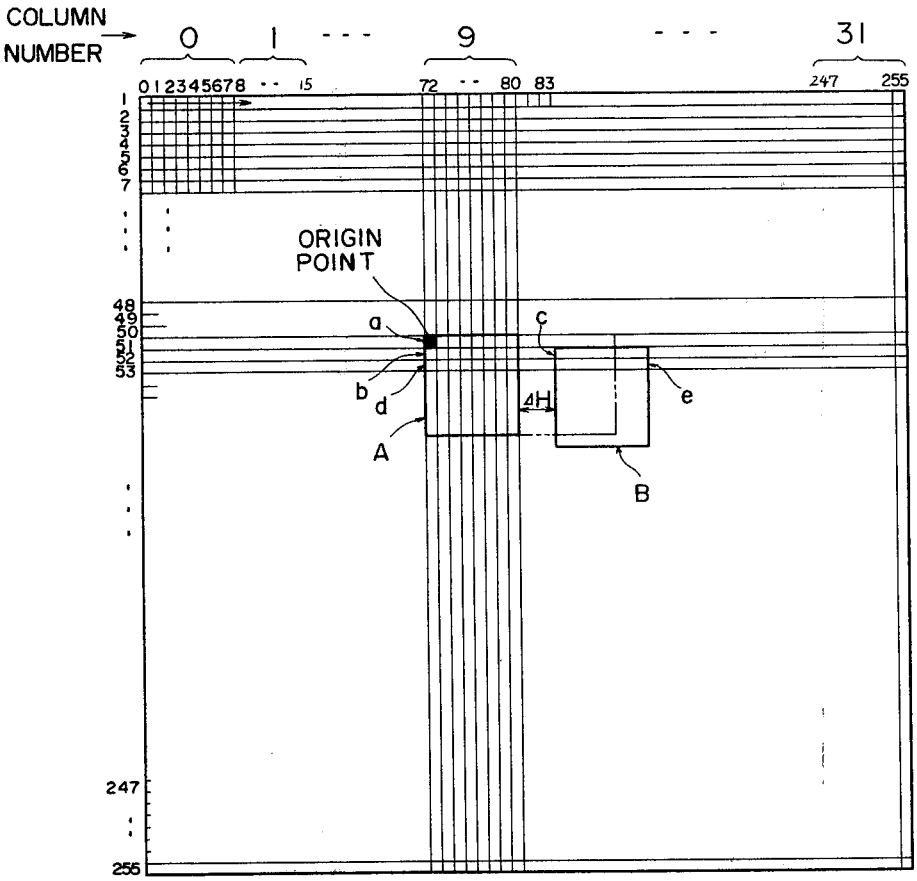
FIG. 5 is a view diagrammatically showing the screen of a scanning type display for explaining the operation of the FIG. 4 diagram.

FIG. 5 is a view diagrammatically showing a screen of a scanning type display for describing an operation of the FIG. 4 diagram. Now referring to FIGS. 4 and 5, an operation of the present invention will be specifically described.

During the vertical blanking period the above described switch circuit 412 provides the write address data obtained from the central processing unit 411 to the above described moving symbol random access memory 413. As a result, the write data obtained from the central processing unit 411 is written in the designated addresses of the random address memory 413. During the period other than the above described vertical blanking period the switch circuit 412 provides the synchronizing signal obtained from the synchronizing counter 414 to the random access memory 413 as the read address data, whereby the data stored in the random access memory 413 is read out.

The above described random access memory 413 is responsive to the synchronizing signal obtained from the synchronizing counter 414 to provide display control information in a bit parallel fashion corresponding to the column in synchronism with the horizontal scanning position during the period when the scanning is made of the horizontal scanning lines to cover eight dots in the vertical direction. For example, consider a case where characters being written are A and B, the abscissa and the reference ordinate of the origin point (the left upper dot position) of the character A are (72, 51), and the abscissa and ordinate of the character B are (83, 52). In such a case, the abscissa of the character A becomes the first dot (i.e. ΔH=0) of the ninth column. In such a case the reference ordinate is 51. The coordinates (83, 52) of the origin point of the character B are the abscissa being the third dot (ΔH=3) of the tenth column and the reference ordinate being 52.

Now consider a case where the ordinate position of the actual horizontal scanning lines of the television receiver 1 is 50. When the ordinate information (72, 51) of the character A is read out, the said reference ordinate information V (51) is applied to the comparator 421. The comparator 421 makes comparison with the ordinate (51) preceding by one line the scanning position (50) of the actual horizontal scanning line of the television receiver 1 which is obtained from the synchronizing counter 43 to provide a write enable signal of the high level to the switch circuit 425 when the difference ΔV of both inputs is zero. On the other hand, the synchronizing counter 43 provides the high level when the ordinate of the horizontal scanning line is the even number address to provide the same to the switch circuits 423 and 425 and to provide the same through the inverter 426 to the switch circuit 424. As a result, the switch circuit 423 provides the abscissa information (H') of the output of the random access memory 413 to the line buffer memory **44*a* as the write address. At the same time, the switch circuit 425 provides a write enable signal to the line buffer memory 44*a*. Accordingly, the storing region corresponding to the ninth column of the line buffer memory 44*a*** is loaded with the character code, the color/brightness code, ΔH (=0) and ΔV (=0) of the character A, with the result that the data of the first line a of the character A is stored.

When the horizontal scanning line of the television receiver 1 becomes the next ordinate position (51), the switch circuit 423 provides the read address and the switch circuit 424 provides the write address. On the other hand, the switch circuit 425 selects the line buffer memory **44*b* to provide the write enable signal when the write enable signal is obtained from the comparator 421. At that time, the synchronizing counter 43 provides the read address data designating the columns in synchronism with the horizontal directional scanning of the horizontal scanning lines of the television receiver 1, thereby to provide the same through the switch circuit 423 to the line buffer memory 44*a*. Accordingly, the line buffer memory 44*a* provides the character code, the color/brightness code, ΔH and ΔV stored in the storing region corresponding to the columns. More specifically, at the timing when the first abscissa position (72) of the column (the ninth column) being read of the first line a of the character A, the character storing memory 45 is responsive to the character code being given at that time and the ΔV (ΔV=0) to provide the data of the first line a of the character A in a bit parallel fashion to the parallel/serial converter 462. At that time the delay 461 generates a conversion start command signal with a delay of a time period determined based on the ΔH; however, since the ΔH is zero, the conversion start command signal is immediately provided. Accordingly, the parallel/serial converter 462 provides in a bit serial fashion the data of the first row a of the character A to provide the same to the mixing circuit 48. At the same time, the conversion start command signal of the delay 461 is applied to the color converter 471 and the brightness converter 472. Accordingly, the color converter 471 convers the color code to the information suited for color display by the television receiver 1, while the brightness converter 472 converts the brightness code to the information suited for brightness display by the television receiver 1. The converted outputs from the color converter 471 and the brightness converter 472 are applied to the mixing circuit 48. The mixing circuit 48 mixes the character information, the color information and the brightness information to provide a video signal, which is applied to the television receiver 1. As a result, the data of the first line a of the character A is displayed on the screen of the television receiver 1 during a time period when the count value of the abscissa of the synchronizing counter 43 is between 72 and 79 when the horizontal scanning line of the television receiver 1 is in the ordinate (51**). Meanwhile, since no character code being displayed is stored in other abscissa positions, nothing is displayed.

In the case where the ordinate position of the horizontal scanning line is 51, the comparator 421 is supplied with information designating the next ordinate position (52) from the synchronizing counter 43. At that time, the difference ΔV between the reference ordinate information (51) supplied from the moving symbol random access memory 413 and the information (52) representing the next ordinates position applied from the synchronizing counter 43 is unity. Therefore, the comparator 421 provides the write enable signal, which is applied to the switch circuit 425. Now considering a case where the data being written in the second line b of the character A is written in the line buffer memory **44*b*, the character code and the color/brightness code of the character a are applied to the line buffer memory 44***b* and the ΔH (=0) and the ΔV (=1) are applied to the line buffer memory 44*b* at the timing of ΔV=1. Therefore, the above described character code, the color/brightness code, the ΔH and the ΔV are written in the storing regions corresponding to the ninth column of the line buffer memory 44*b*. As a result, the data of the second line b of the character A are stored in the storing region corresponding to the ninth column of the line buffer memory 44*b*. It is pointed out that the data stored in the storing region corresponding to the ninth column of the line buffer memory 44*a* and the data stored in the storing region corresponding to the ninth column of the line buffer memory 44*b* are substantially the same, except that the ΔV is unity.

At the timing when the character code, the color/brightness code, the horizontal and vertical coordinate information of the character B are read from the random access memory 413, the comparator 421 provides ΔV=0, inasmuch as the next ordinate obtained from the synchronizing counter 43 and the reference ordinate information (52) of the origin point of the character B are the same. As a result, the storing region of the line buffer memory 44*b* corresponding to the tenth column is loaded with the character code, the color/brightness code, the ΔH (=3) and the ΔV (=0) of the character B. As a result, it follows that the data of the first line c of the character B is stored in the storing region B corresponding to the tenth column of the line buffer memory 44*b*.

When the horizontal scanning line becomes the ordinate position (52) of the television receiver 1, the switch circuit 424 provides the read address, while the switch circuit 423 provides the write address, as done in the previously described case. In addition, the switch circuit 425 enables provision of a write enable signal to the line buffer memory 44*a*.

In the same manner as the previously described operation, at the timing when the character code, the color/brightness code, the abscissa information and reference ordinate information of the character A are obtained from the random access memory 413, the comparator 421 provides the write enable signal, which is applied through the switch circuit 425 to the line buffer memory 44*a*. On the other hand, the comparator 421 provides the ΔV=2. The information of the character code, the color/brightness code, the ΔH (=0) and the ΔV (=2) of the character A, i.e. the data of the third line d of the character A, is written in the storing region corresponding to the ninth column of the line buffer memory 44*a*.

At the timing when the character code, the color/brightness code, the abscissa information and reference ordinate information of the character B is obtained from the moving symbol random access memory 413, the comparator 421 provides the write enable signal and also the ΔV=1. The information of the character code, the color/brightness code, the ΔH (=3) and the ΔV (=1) of the character B, i.e. the data of the second line e of the character B is written in the storing region corresponding to the tenth column of the line buffer memory 44*a*.

In the case where the ordinate position of the above described horizontal scanning line is 52, the line buffer memory 44*a* provides the data corresponding to the respective columns per each column designated by the synchronizing counter 43. For example, when the abscissa position of the horizontal scanning line of the television receiver 1 becomes the abscissa (72) designating the ninth column, the above described data is read out. At that time, the character storing memory 45 reads the information of the second line b of the character A based on the character code and the ΔV (=1), which is applied to the parallel/serial converter 462. The delay 461 is responsive to the ΔH=0 to immediately provide the conversion start command signal. As a result, the information of the second line b of the character A is displayed during the time period corresponding to the ninth column in the television receiver 1.

Now description will be made of a case where display is made with a shift of the abscissa position based on the ΔH. When the synchronizing counter 43 designates the abscissa position corresponding to the tenth column in the case where the ordinate position of the horizontal scanning line is 52, the data corresponding to the tenth column is read out from the line buffer memory 44*b*. At that time, the character storing memory 45 is responsive to the character code and the ΔV (=0) to provide the information of the first line c of the character B in the bit parallel fashion, which is applied to the parallel/serial converter 462. The delay 461 provides the conversion start command signal with a delay corresponding to three dots of the horizontal synchronizing signal based on the ΔH (=3) after the information of the tenth column is read out and the above described signal is applied to the parallel/serial converter 462, the color converter 471 and the brightness converter 472. Accordingly, the parallel/serial converter 462 reads in succession in a bit serial fashion the information of the first line c of the character B from the abscissa position (83) of the horizontal scanning line and the same is applied to the mixing circuit 48. Thus, the data of the first line c of the character B is displayed on the screen of the television receiver 1 during a time period from the abscissa position 83 (i.e. the abscissa position three dots dislocated from the left most abscissa position of the tenth column) to the abscissa position 92 in the ordinate position being 52.

In the case where the cancellation code is read out, the cancellation code detector 473 provides the read inhibiting signal which disables the delay 461, thereby to prohibit generation of the conversion start command signal, whereby no character is displayed.

Likewise thereafter, the line buffer memories 44*a* and 44*b* are switched alternately to the write mode and the read mode per each line of the horizontal scanning lines, while the reading is made from the abscissa information delayed by the ΔV from the abscissa position representing the left-most dot of the columns.

It follows that the information of the respective lines of each character is read out while the same is dislocated in succession in the direction of the ordinate by the number of dots determined based on a difference between the ordinate position of the preceding horizontal scanning line evaluated by the comparator 421 and the ordinate of the origin point of the character being displayed read from the moving symbol random access memory 413.

Meanwhile, in the case where the column dislocated by the ΔH in the abscissa position and the column not dislocated in the abscissa position are consecutive, it follows that there exist two pieces of information at the abscissa and ordinate positions of the same display timing. In such a case, it is determined that the one of a larger column number is to be read out preferentially.

Meanwhile, in the foregoing, a description was made of a case where reading is made while the abscissa position is dislocated by seven dots at the maximum from the left-most abscissa position of the column; however, the present invention may be applied to a variety of modifications without being limited thereto. Therefore, in the following, a description will be made of a case where a modified character is generated by disclocating the ΔV at each line of a character of an image symbol unit.

Figure 6:
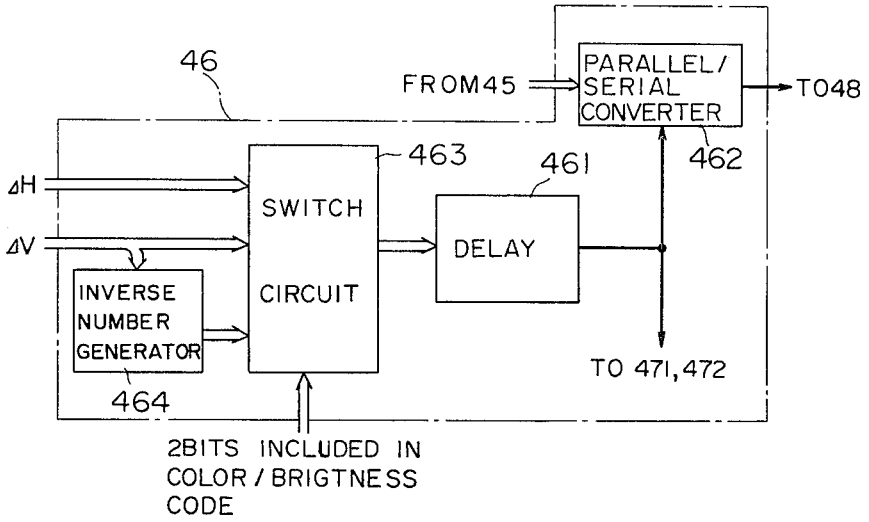
FIG. 6 is a block diagram of pattern information withdrawal control means for use in another embodiment of the present invention.
Figure 7A:
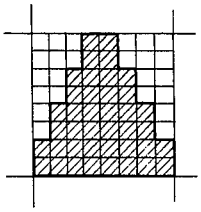
FIGS. 7A to 7C are a view showing a case where characters are displayed in an inclined manner in the FIG. 6 embodiment.

FIG. 6 is a block diagram of a pattern information withdrawal control means 46 for use in another embodiment of the present invention. The embodiment shown comprises a switch circuit 463 between the delay 461 and the outputs of the line buffer memories 44*a* and 44*b*. The switch circuit 463 has three switch input terminals. These input terminals are connected to receive the ΔH, the ΔV and an output of an inverse number generator 464 receiving the ΔV. The switch circuit 463 receives two bits of the color/brightness code of eight bits as a switch signal thereof serving as information representing an inclined direction, which is stored in the line buffer memory 44*a* or 44*b*. The above described code of two bits representing the inclined direction is determined as a code for commanding normal reading without any inclination as shown in FIG. 7A, a code for commanding display of a character with inclination of 45° (i.e. with inclination in the right downward direction as shown in FIG. 7B), or a code for commanding display of a character with inclination of −45° (i.e. inclination in the right upward direction as shown in FIG. 7C).

Now referring to FIGS. 6 and 7A to 7C, description will be made of a case where modified characters are displayed based on the same character information. First in the case where a character is displayed with any modification, the code for commanding normal reading is applied to the switch circuit 463. Accordingly, the switch circuit 463 selects the ΔH to provide the same to the delay 461. As a result, the delay 461 displays the character without any modification with displacement only in the horizontal direction, as done in the previously described operation in conjunction with FIG. 4.

Figure 7B:
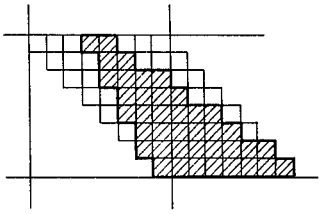

In the case where display is to be made with inclination in the right downward direction as shown in FIG. 7B, the code for commanding the +45° inclination is applied to the switch circuit 463. Accordingly, the switch circuit 463 selects the ΔV to provide the same to the delay 461. Meanwhile, when the origin point of one character is assumed to be ΔV=0, the ΔV increases one per each line of the character with the maximum being 7. Therefore, the delay provides the conversion start command signal with a delay of a time period associated with the value of the ΔV (i.e. a time period associated with the number of dots corresponding to the distance in which the horizontal scanning lines moves in the horizontal direction) to provide the said signal to the parallel/serial converter 462. As a result, the character is displayed with the right downward inclination even with the same character information.

Figure 7C:
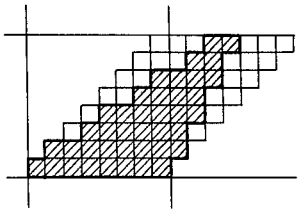

In the case where display is made of a character with right upward inclination as shown in FIG. 7C, the code for commanding 45° inclination is applied to the switch circuit 463. The switch circuit 463 selects the reverse number generator 464 and the output thereof is applied to the delay 461. The smaller the ΔV being applied to the reverse number generator 464 the larger value (say 7 if ΔV=0) the reverse number generator 464 provides, whereas the larger the ΔV the smaller value (0 if ΔV=7). More specifically, the reverse number generator 464 provides a reverse number value of the ΔV to provide the same to the delay 461. As a result, a character is displayed with inclination in the reverse direction as compared with a case of the previously described +45° inclination.

Thus, the FIG. 6 embodiment can generate three kinds of characters based on the data representing a character of one image symbol unit. Accordingly, the number of kinds of characters can be increased by using the same capacity of the character pattern storing memory and conversely the memory capacity can be decreased in order to generate the same number of characters.

Although the foregoing embodiments were described by taking an example in which a scanning type display is used as a video game apparatus to display a moving image symbol as a character, it is needless to say that the present invention may be applied to other applications. In such a case, a character may be an image symbol displayed as not moving or still.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A display control apparatus of a scanning type display for displaying an image on a screen through repetition of a horizontal scanning operation and a vertical scanning operation, said scanning type display comprising an arrangement of a relatively large plurality (m×n) of dots on the screen arranged in the horizontal and vertical directions by the numbers m and n, respectively, an image symbol as a unit being displayed comprising an arrangement of a relatively small plurality (x×y) of dots arranged in the horizontal and vertical directions by the dot numbers x and y, respectively, one or more of image symbols being displayed on the screen arranged in columns of the number (m/x) obtained by dividing the dot number (m) in the horizontal direction of the relatively large plurality (m×n) of numbers by the dot number (x) in the horizontal direction of the relatively small plurality (x×y) of numbers, said apparatus comprising:

a character pattern storing memory for storing a plurality of kinds of pattern information concerning characters each being displayed as said unit image symbol and having its own predetermined character identifying information for each kind thereof, display control information generating means for generating display control information during one horizontal scanning period, said display control information including abscissa information for designating the column in the horizontal direction of said image symbol being displayed on said screen, reference ordinate information of said image symbol, and said character identifying information of said image symbol, additional ordinate information generating means for providing additional ordinate information (ΔV) based on a difference between ordinate information preceding by a predetermined number of lines the actual ordinate position of the horizontal scanning line of said scanning type display and ordinate information of said image symbol, a first line buffer memory including storing regions for storing at least said character identifying information and said additional ordinate information ($\Delta V$) for each column of said horizontal scanning lines, a second line buffer memory including storing regions for storing at least said character identifying information and said additional ordinate information ($\Delta V$) for each column of the horizontal scanning lines spaced apart by a predetermined number of lines from said horizontal scanning lines stored in said first line buffer memory, synchronizing signal generating means for generating a synchronizing signal associated with the abscissa and ordinate of the actual scanning position of said horizontal scanning line, write/read control means for placing one of said first and second line buffer memories in an information write mode and for placing the other of said first and second line buffer memories in an information read mode alternately at every predetermined number of lines of said horizontal scanning lines, and pattern information withdrawal control means responsive to the read output from said other line buffer memory for reading the pattern information of the kind corresponding to the character identifying information from said character pattern storing memory for providing the same to said scanning type display.

2. A display control apparatus of a scanning type display in accordance with claim 1, wherein said display control information generating means generates additional abscissa information ($\Delta H$) representing the number of dots ($x'$; where $0 \leqq x' < x$) for displaying the image symbol, with said image symbol being displaced in the horizontal direction with respect to the column of said abscissa information, said first and second line buffer memories each further comprise a storing region for storing said additional abscissa information, and said pattern information withdrawal control means provides said pattern information of said character of the kind corresponding to said character identifying information which is the information of the dot number (x) in the horizontal direction of said relatively small plurality of dots based on said additional ordinate information, with the same displaced in the horizontal direction by the dot number associated with said additional abscissa information.

3. A display control apparatus of a scanning type display in accordance with claim 2, wherein said image symbol is a moving image symbol displayed visually such that the display position on said screen is changeably moving.

4. A display control apparatus of a scanning type display in accordance with claim 1, wherein said predetermined number of lines is one line.

5. A display control apparatus of a scanning type display in accordance with claim 1, wherein said additional ordinate information generating means provides additional ordinate information associated with a difference based on the fact that the difference between said ordinate information and said reference ordinate reference is smaller than the dot number (y) in the vertical direction of the relatively small plurality of dots.

6. A display control apparatus of a scanning type display in accordance with claim 1, wherein said display control information generating means is adapted to further generate modification command information for commanding modification of said character with a given angle, said first and second line buffer memories each comprise a further storing region for storing said modification command information, said pattern information withdrawal control means is responsive to said modification command signal read from said other line buffer memory for dislocating, in the horizontal direction per each dot position in the vertical direction of said unit image symbol, the reading of said pattern information of said character of said kind corresponding to said character identifying information read from said line buffer memory which is the information of the dot number (x) in the horizontal direction of said relatively small plurality of dots based on said additional ordinate information.

7. A display control apparatus of a scanning type display in accordance with claim 1 or 6, wherein said scanning type display is adapted to be capable of displaying said image symbol in color, said display control information generating means is adapted to further generate a color/brightness code for representing a color and brightness of said character designated by said character identifying information, said first and second line buffer memories each comprise a further storing region for storing said color/brightness code, and which further comprises color/brightness signal generating means for generating a color/brightness signal based on said color/brightness code read from said other line buffer memory.

8. A display control apparatus of a scanning type display in accordance with claim 6, wherein said modification command information comprises inclined direction command information for commanding a right downward or right upward inclined direction with respect to the horizontal direction, and said pattern information withdrawal control means is responsive to said inclined direction command information for selecting the direction of dislocating the reading of information of said dot number (x) of the relatively small plurality of dots.

9. A display control apparatus of a scanning type display in accordance with claim 1, wherein said display control information generating means comprises image information storing means for storing said display control information of an image symbol being displayed on the screen for each of a plurality of screens, and read control means for controlling a reading operation of image information storing means.

* * * * *